US008699935B2

(12) United States Patent
Yamanaka et al.

(10) Patent No.: US 8,699,935 B2
(45) Date of Patent: Apr. 15, 2014

(54) DEVELOPER CONVEYING APPARATUS AND IMAGE FORMING APPARATUS

(75) Inventors: Kazumi Yamanaka, Kanagawa (JP); Yoshihiro Enomoto, Kanagawa (JP); Masaaki Tokunaga, Kanagawa (JP); Hirofumi Goto, Kanagawa (JP); Shinichi Kawamata, Kanagawa (JP); Hiroaki Yagi, Kanagawa (JP); Masakazu Shirai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 628 days.

(21) Appl. No.: 12/549,922

(22) Filed: Aug. 28, 2009

(65) Prior Publication Data

US 2010/0232851 A1 Sep. 16, 2010

(30) Foreign Application Priority Data

Mar. 16, 2009 (JP) ..... P2009-063108

(51) Int. Cl.
*G03G 21/00* (2006.01)
*G03G 21/10* (2006.01)

(52) U.S. Cl.
CPC ..... *G03G 21/105* (2013.01)
USPC ..... 399/358

(58) Field of Classification Search
CPC ..... G03G 21/105
USPC ..... 399/358
See application file for complete search history.

(56) References Cited

U.S. PATENT DOCUMENTS

2006/0222408 A1 10/2006 Suenami et al.
2007/0223969 A1 * 9/2007 Nishimura et al. ..... 399/254

FOREIGN PATENT DOCUMENTS

JP 2004-177754 6/2004
JP 2006-301604 11/2006

* cited by examiner

*Primary Examiner* — David Gray
*Assistant Examiner* — Andrew Do
(74) *Attorney, Agent, or Firm* — Morgan, Lewis & Bockius LLP

(57) ABSTRACT

A developer-conveying apparatus is provided, the developer-conveying apparatus including: a conveying member that has a rotational axis rotatably set in a container and a blade formed around the rotational axis, the conveying member conveying a developer along the rotational axis by rotation; and a static eliminating member set in the container and eliminating static electricity of the developer in the container by being brought into contact with the developer.

5 Claims, 4 Drawing Sheets

DEVELOPER CONVEYING APPARATUS AND IMAGE FORMING APPARATUS

CROSS-REFERENCE TO RELATED APPLICATIONS

This application is based on and claims priority under 35 U.S.C. 119 from Japanese Patent Application No. 2009-063108 filed Mar. 16, 2009.

BACKGROUND

1. Technical Field

The present invention relates to a developer-conveying apparatus and an image-forming apparatus.

2. Related Art

In developing apparatus of image-forming apparatus such as copiers, printers, and facsimiles of electrophotographic systems, toner-conveying apparatus for conveying toners in the axial direction of conveying member by rotating the conveying member comprising a blade formed helically on the circumferential surface of the axis are generally used. It is known that a toner is aggregated and conveying ability lowers in such a conveying apparatus.

SUMMARY

According to an aspect of the present invention, there is provided a developer-conveying apparatus including:

a conveying member that has a rotational axis rotatably set in a container and a blade formed around the rotational axis, the conveying member conveying a developer along the rotational axis by rotation; and a static eliminating member set in the container and eliminating static electricity of the developer in the container by being brought into contact with the developer.

BRIEF DESCRIPTION OF THE DRAWINGS

Exemplary embodiment of the present invention will be described in detail based on the following figures, wherein.

DETAILED DESCRIPTION

Figure 1:
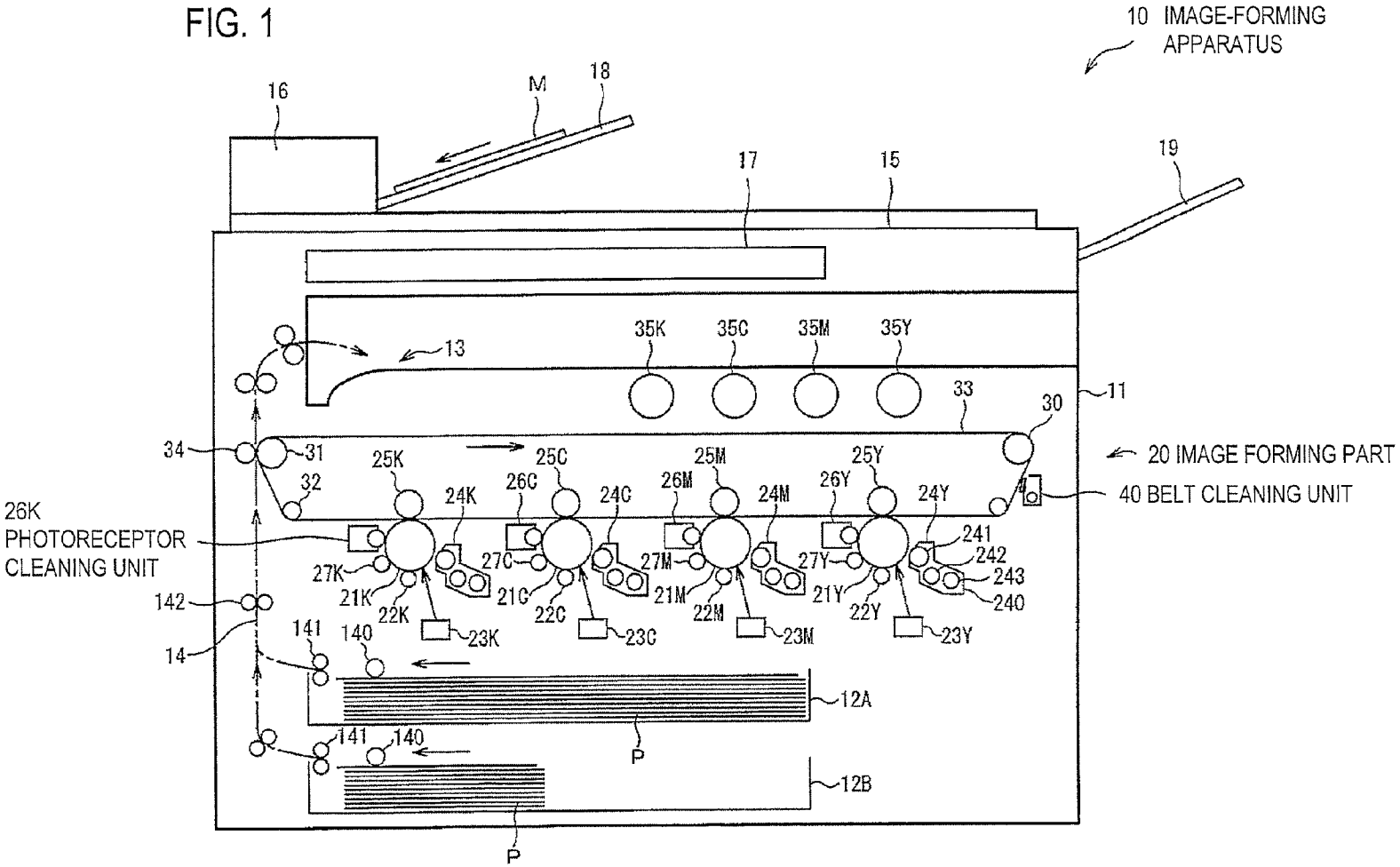
FIG. 1 is a block diagram showing an example of the image-forming apparatus according to the exemplary embodiment of the invention.

FIG. 1 is a block diagram showing an example of the image-forming apparatus according to the exemplary embodiment of the invention. This image-forming apparatus 10 has almost box-shaped body of apparatus 11. In the lower part of the body of apparatus 11, plural attachable and detachable paper feeding trays 12A, 12B for housing paper P as a recording medium are provided. In the space of the body of apparatus 11, paper discharge port 13 to which recorded paper P is discharged is arranged, and paper conveying route 14 leading to the paper discharge port 13 from the paper feeding trays 12A, 12B is formed.

On the paper conveying route 14, pickup roll 140 for feeding paper P one by one from the paper feeding trays 12A, 12B to the paper conveying route 14, disposing roll 141 for disposing paper P, and conveying roll 142 for conveying the paper P are arranged.

In image-forming apparatus 10, operation display part 15 for inputting and displaying various data, and ADF (automatic manuscript feeder) 16 are arranged on body of apparatus 11. On the upper part of the body of apparatus 11, read part 17 for optically reading an original image from manuscript M is provided. ADF 16 is a member for automatically feeding the manuscript M distributed to manuscript tray 18 to read part 17, and the manuscript M read by read part 17 is discharged to manuscript discharge tray 19.

Further, in image-forming apparatus 10, image forming part 20 is arranged at the upper part of paper feeding trays 12A, 12B in body of apparatus 11. Image forming part 20 is provided with photoreceptors 21Y, 21M, 21C, 21K on which toner images of respective colors of yellow (Y), magenta (M), cyan (C), and black (K) are formed while rotating in the directions of arrows in the figure, chargers 22Y, 22M, 22C, 22K for evenly charging the surfaces of photoreceptors 21Y, 21M, 21C, 21K, exposing units 23Y, 23M, 23C, 23K for forming electrostatic latent images of respective colors of Y, M, C and K by irradiating charged photoreceptors 21Y, 21M, 21C, 21K with exposure lights modulated to respective colors based on image data of respective colors of Y, M, C and K, and developing units 24Y, 24M, 24C, 24K for forming toner images on the surfaces of photoreceptors 21Y, 21M, 21C, 21K by developing the electrostatic latent images with toners and carriers as one example of the developers in the exemplary embodiment.

Each of developing units 24Y, 24M, 24C, 24K has housing 240 for housing each toner. In housing 240, developing roller 241 for supplying toners to photoreceptors 21Y, 21M, 21C, 21K, and developing the electrostatic latent images on photoreceptors 21Y, 21M, 21C, 21K with the toners, supply auger 242 for supplying toners to developing roller 241, and stirring auger 243 for stirring toners and at the same time supplying toners to supply auger 242 are arranged. Further, toners of respective colors are supplied from toner boxes 35Y, 35M, 35C, 35K to developing units 24Y, 24M, 24C, 24K. The toner boxes may contain toners and magnetic carriers, or may contain toner alone not containing carriers.

Image forming part 20 is provided with photoreceptor cleaning units 26Y, 26M, 26C, 26K for collecting the toners remaining on the surfaces of photoreceptors 21Y, 21M, 21C, 21K after transfer, and static eliminating members 27Y, 27M, 27C, 27K for eliminating static electricity of photoreceptors 21Y, 21M, 21C, 21K after transfer.

Image forming part 20 is provided with intermediate transfer belt 33 strained by driving roll 30, backup roll 31, and driven roll 32. Intermediate transfer belt 33 moves circularly in the direction of arrow in the figure contacting with photoreceptors 21Y, 21M, 21C, 21K.

First transfer rolls 25Y, 25M, 25C, 25K are provided on the opposite side of photoreceptors 21Y, 21M, 21C, 21K with intermediate transfer belt 33 in between. First transfer rolls 25Y, 25M, 25C, 25K transfer the toner images on the surfaces of photoreceptors 21Y, 21M, 21C, 21K to intermediate transfer belt 33 by pressure and static electricity in nip areas formed with photoreceptors 21Y, 21M, 21C, 21K.

Second transfer roll 34 is provided on the opposite side of backup roll 31 with intermediate transfer belt 33 in between. Second transfer roll 34 performs secondary transfer of the toner image on intermediate transfer belt 33 to paper P in nip areas formed with backup roll 31.

Image forming part 20 is provided with belt cleaning unit 40, to which the developer conveying apparatus of the invention is applied, on the upstream of photoreceptor 21Y arranged in the conveying direction of intermediate transfer belt 33 and on the opposite side of driving roll 30 with intermediate transfer belt 33 in between. The belt cleaning unit 40 is pressed toward driving roll 30 side to scrape off and collect the toner remaining on intermediate transfer belt 33.

Figure 2:
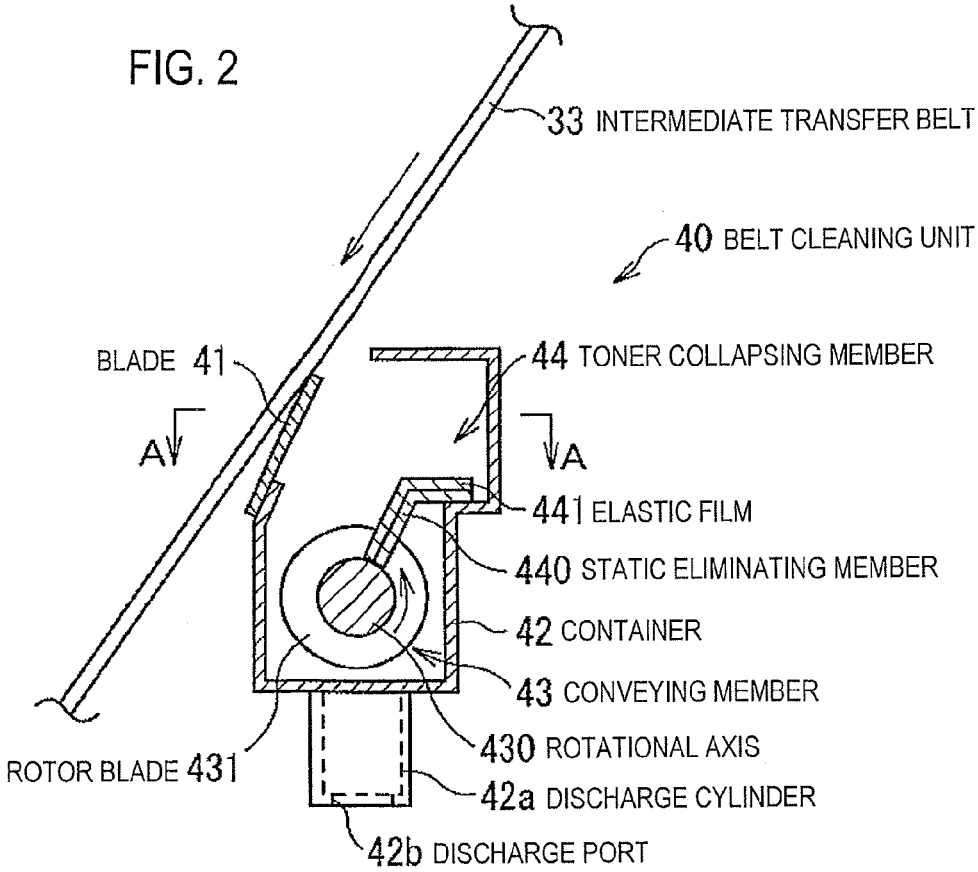
FIG. 2 is a cross-sectional view showing schematic construction of the belt cleaning apparatus according to the exemplary embodiment of the invention.
Figure 3:
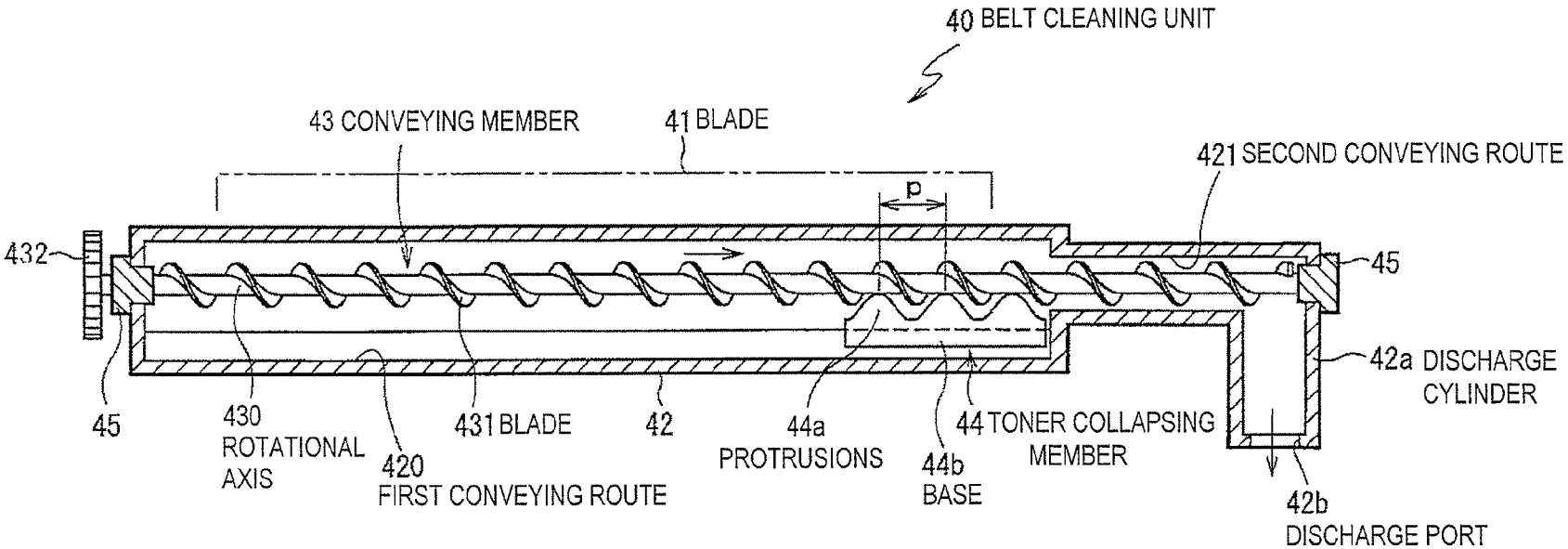
FIG. 3 is a cross-sectional view of line A-A in FIG. 2.
Figure 4:
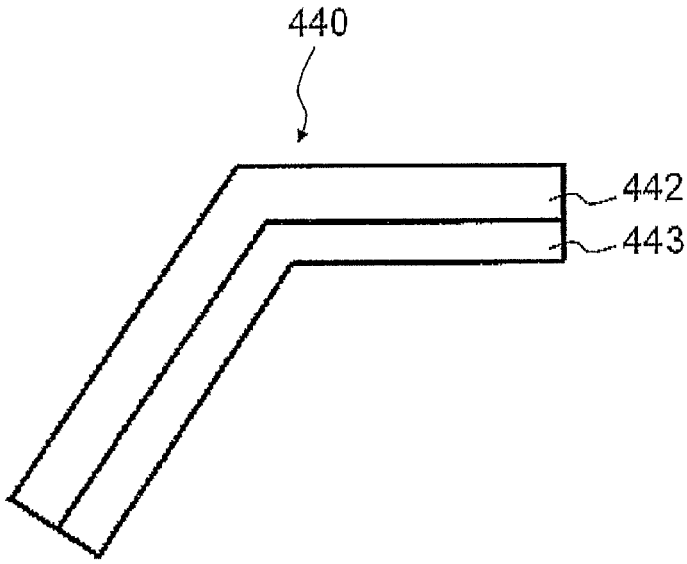
FIG. 4 illustrates a static eliminating member according to an exemplary embodiment of the present invention.

FIG. 2 is a cross-sectional view showing schematic construction of the belt cleaning apparatus. FIG. 3 is a cross-sectional view of line A-A in FIG. 2.

Belt cleaning unit 40 is provided with blade 41 as one example of scraping member for scraping off the toner remaining on the surface of intermediate transfer belt 33 by contacting with the surface of intermediate transfer belt 33, container 42 for housing the collected container scraped off by blade 41 and collected, conveying member 43, which is provided in container 42 so as to be freely rotatable, for conveying the collected toner in container 42 in the direction of the arrow in the figure by rotating, and discharging the collected toner to the collected toner tank not shown in the figure from discharge port 42*b* formed in discharge cylinder 42*a* provided so as to be protruded downward in the weight direction from the end part of container 42, toner collapsing member 44 for collapsing the collected toner accumulated on conveying member 43, and a motor not shown in the figure for rotating conveying member 43.

As blade 41, an elastic blade comprising an elastic member such as rubber and silicon resins may be used. In place of blade 41, a metal scraper consisting of a metal of SUS304 and the like may be used, or after scraping off the toner with an elastic blade, the residues on intermediate transfer belt 33 may be scraped with a metal scraper.

Conveying member 43 is provided with rotational axis 430, rotor blade 431 helically-formed around the rotational axis 430, and gear 432 provided at the end part of rotational axis 430 for rotating rotational axis 430 in the direction of the arrow in FIG. 2 by the application of torque of the motor. Conveying member 43 is attached to container 42 by bearings 45 at both end parts so as to be freely rotatable. Conveying member 43 is generally formed of resins, e.g., ABS resin, polycarbonate resin, polyacetal resin, polystyrene resin, and the like, or metals, e.g. aluminum. Incidentally, the rotor blade may not be helically-formed around rotational axis 430, so long as it has a form capable of conveying a developer in the axial direction of rotational axis 430 in response to the rotation of rotational axis 430, such that plural feed plates may be provided on rotational axis 430 with inclination.

Container 42 has first conveying route 420 to convey the collected toner, and second conveying route 421 provided leading out of first conveying route 420 on the downstream of first conveying route 420 in the conveying direction of the developer for conveying the collected developer conveyed from first conveying route 420 to the collected toner tank. The cross section of second conveying route 421 on the vertical plane in the axis direction of the rotational axis is smaller than that of first conveying route 420.

Toner collapsing member 44 is provided in first conveying route 420 and on the border with second conveying route 421. At least a part of toner collapsing member 44 is provided correspondingly on downstream end part of blade 41 in the conveying direction of the collected toner, but the entire of toner collapsing member 44 may be provided correspondingly on downstream end part of blade 41.

Toner collapsing member 44 is provided with static eliminating member 440 for eliminating static electricity of the collected toner, and elastic film 441 which is an example of an elastic member and is disposed to be in touch with the rotor blade 431 of the conveying member 43. The toner collapsing member 44 has plural (for example, 3) protrusions 44*a*, the tip parts of which have the same pitch with the pitch of the rotor blade, and base 44*b* fixed to container 42 by an adhesive or screws. Here, "pitch" is the distance between continuous rotor blades in the axial direction of the rotational axis. When plural feed plates are provided with inclination, it means the distance between contiguous plates in the axial direction of the rotational axis. By making the pitch of the rotor blade and the pitch of protrusions 44*a* the same, protrusions 44*a* start contacting to rotating rotor blade with completely the same timing and released from contacting with the same timing, so that the wavelength and the phase at the time of vibration coincide, by which elastic film 441 at large moves the same. By the same movement of elastic film 441, the performance of collapsing the collected toner is improved as compared with the case where the tips move differently.

Static eliminating member 440 includes nonwoven fabric of resin fiber such as polyester and the like, or a conductive material formed on the surface of the nonwoven fabric, and adhered with an adhesive on the surface of the upstream side of elastic film 441. As static eliminating member 440, for example, Wiping Cloth (manufactured by Japan Vilene Company, Ltd.) may be used. Static eliminating member 440 may be in contact with the earth, although not in contact with the earth in the exemplary embodiment. Further, static eliminating member 440 may be merely a bundle of fibers.

Elastic film 441 includes resins such as PET (polyethylene terephthalate resin) having a thickness of 0.01 to 0.5 mm, preferably 0.02 to 0.08 mm or so. From the point of restraining noise and toner splashing, proper elasticity may be given to static eliminating member 440 by selecting the thickness of elastic film 441.

(Motion of Belt Cleaning Unit)

In the next place, the operation of belt cleaning unit 40 is described. The toner remaining on the surface of intermediate transfer belt 33 is scraped off by blade 41 of belt cleaning unit 40, and housed in container 42. The toner housed in container 42 is conveyed to the direction of discharge cylinder 42*a* by rotating conveying member 43, and discharged into collected toner tank (not shown in the figure) via discharge port 42*b*.

Even when the toner housed in container 42 is electrically aggregated, elastic film 441 has elasticity, so that elastic film 441 vibrates and physically collapses the collected toner by rotating conveying member 43. Elastic film 441 is provided with static eliminating member 440, and static eliminating member 440 eliminates static electricity by discharging the static electricity of the collected toner to the air, the aggregated collected toner is easily collapsed as compared with the case where the toner is charged. Further, static eliminating member 440 also functions as the damping material of elastic film 441, and it controls the vibration of elastic film 441 and reduces noises as compared with the case where static eliminating member 440 is not provided. Thus, the collected toner aggregated in container 42 is efficiently collapsed by elimination of static electricity by static eliminating member 440 coupled with function of collapsing by elastic film 441. By this mechanism, the collected toner aggregated in container 42 may be prevented from becoming the hindrance of conveying in container 42 and the collected toner from staying in container 42.

The invention is not restricted to the exemplary embodiment and modifications may be made therein without departing from the spirit and scope thereof. For example, toner collapsing member 44 is provided in belt cleaning unit 40 in the exemplary embodiment, but it may be provided other places, for example, in photoreceptor cleaning units 26Y, 26M, 26C, 26K or developing units 24Y, 24M, 24C, 24K.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developer-conveying apparatus comprising:

a conveying member that has a rotational axis rotatably set in a container and a blade formed around the rotational axis, the conveying member conveying a developer along the rotational axis by rotation;

a static eliminating member set in the container and eliminating static electricity of the developer in the container by being brought into direct contact with the developer, and a collapsing member that collapses the developer in the container, wherein the collapsing member comprises an elastic member and the static eliminating member, such that the static eliminating member adheres on a surface of the elastic member, and the elastic member is arranged so as to be in contact with the blade of the conveying member; and wherein the static eliminating member includes a nonwoven fabric formed from a resin fiber, and a conductive material formed on a surface of the nonwoven fabric.

2. An image-forming apparatus comprising:

an exposure unit that forms an electrostatic latent image on a photoreceptor according to image data;

a developing unit that develops the electrostatic latent image on the photoreceptor with a developer to form an image;

a transfer unit that transfers the image formed by the developing unit to a recording medium, the image being transferred through an intermediate transfer member or directly transferred to the recording medium; and the developer-conveying apparatus according to claim 1 that scrapes off a developer remaining on the photoreceptor or the intermediate transfer member by a scraping member, and conveys the scraped developer to a collected developer container; and wherein the developer-conveying apparatus has:

a first conveying route to convey the developer; and a second conveying route provided leading out of the first conveying route on a downstream of the first conveying route in the conveying direction of the developer, the second conveying route conveying the developer conveyed from the first conveying route to the collected developer container, and wherein a cross section of the second conveying route on a vertical plane in an axis direction of the rotational axis is smaller than that of the first conveying route, and the static eliminating member is provided in the first conveying route and at a border with the second conveying route.

3. The image-forming apparatus according to claim 2, wherein at least a part of the static eliminating member lies downstream of a downstream side end of the scraping member in a conveying direction of the developer.

4. A developer-conveying apparatus comprising:

a conveying member that has a rotational axis rotatably set in a container and a blade formed around the rotational axis, the conveying member conveying a developer along the rotational axis by rotation;

a static eliminating member set in the container and eliminating static electricity of the developer in the container by being brought into direct contact with the developer, and a collapsing member that collapses the developer in the container, wherein the collapsing member comprises an elastic member and the static eliminating member, such that the static eliminating member adheres on a surface of the elastic member, and the elastic member is arranged so as to be in contact with the blade of the conveying member;

wherein the blade of the conveying member is helically-formed around the rotational axis with a constant pitch, and the static eliminating member has a plurality of protrusions having a same pitch with the pitch of the blade of the conveying member.

5. A developer-conveying apparatus comprising:

a conveying member that has a rotational axis rotatably set in a container and a blade formed around the rotational axis, the conveying member conveying a developer along the rotational axis by rotation;

a static eliminating member set in the container and eliminating static electricity of the developer in the container by being brought into contact with the developer; and a collapsing member that collapses the developer in the container, wherein the collapsing member comprises an elastic member and the static eliminating member that adhere to each other, the elastic member being arranged so as to be in contact with the blade of the conveying member, and wherein the elastic member is formed from resin.

* * * * *